US008453767B2

(12) United States Patent
Cariveau

(10) Patent No.: US 8,453,767 B2
(45) Date of Patent: Jun. 4, 2013

(54) ANGULAR OFFSET PDC CUTTING STRUCTURES

(75) Inventor: Peter Thomas Cariveau, Spring, TX (US)

(73) Assignee: Smith International, Inc., Houston, TX (US)

( * ) Notice: Subject to any disclaimer, the term of this patent is extended or adjusted under 35 U.S.C. 154(b) by 1646 days.

(21) Appl. No.: 11/129,060

(22) Filed: May 13, 2005

(65) Prior Publication Data

US 2006/0254829 A1 Nov. 16, 2006

(51) Int. Cl.
*E21B 10/00* (2006.01)

(52) U.S. Cl.
USPC ..... 175/350; 175/61

(58) Field of Classification Search
USPC ..... 175/350, 61, 62
See application file for complete search history.

(56) References Cited

U.S. PATENT DOCUMENTS

| | | | | | |
|---|---|---|---|---|---|
| 1,856,437 | A | * | 5/1932 | Seifert | 175/338 |
| 2,013,839 | A | * | 9/1935 | Pickin | 175/340 |
| 2,336,333 | A | * | 12/1943 | Zublin | 175/290 |
| 2,336,335 | A | | 12/1943 | Zublin | |
| 4,580,642 | A | | 4/1986 | Gosch | |
| 4,817,740 | A | * | 4/1989 | Beimgraben | 175/74 |
| 4,836,303 | A | * | 6/1989 | Boulet et al. | 175/74 |
| 5,010,789 | A | | 4/1991 | Brett et al. | |
| 5,042,596 | A | | 8/1991 | Brett et al. | |
| 5,109,935 | A | | 5/1992 | Hawke | |
| 5,259,467 | A | * | 11/1993 | Schoeffler | 175/38 |
| 5,597,046 | A | * | 1/1997 | Fisk | 175/67 |
| 5,673,765 | A | * | 10/1997 | Wattenburg et al. | 175/322 |
| 5,775,443 | A | * | 7/1998 | Lott | 175/57 |
| 6,234,261 | B1 | * | 5/2001 | Evans et al. | 175/374 |
| 2004/0040748 | A1 | | 3/2004 | Puttmann | |

OTHER PUBLICATIONS

Combined Search and Examination Report issued in corresponding British Application No. GB0609367.8; Dated Aug. 31, 2006; 5 pages.
Examination Report issued in corresponding Canadian Application No. 2,546,159; Dated Jun. 8, 2011 (3 pages).
Examination Report issued in related Canadian Application No. 2,546,159, dated Oct. 2, 2008, (2 pages).

* cited by examiner

*Primary Examiner* — Shane Bomar
(74) *Attorney, Agent, or Firm* — Osha Liang LLP

(57) ABSTRACT

A drill bit with a drill bit body having a cutting structure face. A pin is formed on the drill bit body for attaching the drill bit body to a drill string. The pin has a first central axis to be aligned with the drill string when attached and the cutting structure face has a second central axis. The second central axis is misaligned relative to the first central axis.

20 Claims, 6 Drawing Sheets

ANGULAR OFFSET PDC CUTTING STRUCTURES

BACKGROUND OF INVENTION

1. Field of the Invention

The invention relates generally to drill bits used to drill wellbores through the earth. More particularly, the invention relates to polycrystalline diamond compact ("PDC") drill bits having directional drilling characteristics.

2. Background Art

Drill bits in general are well known in the art. In recent years a majority of drag bits have been designed using hard PDC as cutting elements. The cutting elements are mounted on a rotary bit and oriented so that each PDC engages the rock face at a desired angle. The bit is attached to the lower end of a drill string and is typically rotated by rotating the drill string at the surface.

The cost of drilling a borehole is proportional to the length of time it takes to drill the borehole to the desired depth and location. The drilling time, in turn, is greatly affected by the number of times the drill bit must be changed in order to reach the targeted depth or formation.

In recent years, the PDC bit has become an industry standard for cutting formations of grossly varying hardnesses. The cutting elements used in such bits are formed of extremely hard materials and include a surface layer of polycrystalline diamond material. In the typical PDC bit, each cutter element or assembly comprises an elongate and generally cylindrical support member which is received and secured in a pocket formed in the surface of the bit body. A PDC cutter typically has a hard cutting layer of polycrystalline diamond exposed on one end of its support member, which is typically formed of tungsten carbide.

The configuration or layout of the PDC cutters on a bit face varies widely, depending on a number of factors. One of these is the formation itself, as different cutter layouts cut the various strata differently. In running a bit, the driller may also consider weight on bit (WOB), rotation speed (RPM), rate of penetration (ROP), and the weight and type of drilling fluid. Additionally, a desirable characteristic of the bit it that it be "stable" and resist vibration. A severe type or mode of destructive vibration is known as "whirl." "Whirl" is a term used to describe the phenomenon wherein a drill bit rotates about an axis that gyrates offset from the geometric center of the drill bit. Whirling subjects the cutting elements on the bit to alternating increased loading and impact with the formation, which causes the premature wearing or destruction of the cutting elements and a loss of penetration rate. U.S. Pat. Nos. 5,109,935 and 5,010,789 disclose various techniques for reducing whirl by compensating for imbalance in a controlled manner. In general, optimization of placement and orientation of blades and cutters and overall design of the bit have been the objectives of extensive research efforts.

Directional and horizontal drilling have also been the subject of much research. Directional and horizontal drilling involves deviation of the borehole from vertical. Frequently, this drilling program results in boreholes whose remote ends are approximately horizontal. Advancements in measurement while drilling (MWD) technology have made it possible to track the position and orientation of the wellbore. Increasingly, accurate information about the location of the target formation is often available to drillers as a result of improved logging techniques and methods such as geosteering. These increases in available information have raised the expectations for drilling performance. For example, a driller today may target a relatively narrow, horizontal oil-bearing stratum, and may wish to maintain the borehole within the stratum once he has entered it. In more complex scenarios, highly specialized "design drilling" techniques are preferred, with highly tortuous well paths having multiple directional changes of two or more bends lying in different planes.

A common way to control the direction in which the bit is drilling is to steer using a turbine, downhole motor attached to a drill string and fixing a bent rod or "sub" behind the motor. As shown in FIG. 1, a simplified version of a downhole steering system according to the prior art comprises a rig 1, drill string 2, bent sub 4, motor 6 housed in bent sub 4, and drill bit 8. The motor 6 and bent housing 4 form part of the bottom hole assembly (BHA) and are attached to the lower end of the drill string 2 adjacent the bit 8. When not rotating, the bent housing causes the bit face to be canted with respect to the tool axis. The downhole motor is below the bend in the housing. The motor is capable of converting fluid pressure from fluid pumped down the drill string into rotational energy at the bit. This allows the bit to be rotated without rotating the drill string. When a downhole motor is used with a bent housing and the drill string is not rotated, the rotating action of the motor normally causes the bit to drill a hole that is deviated in the direction of the bend in the housing. When the drill string is rotated, the borehole normally maintains direction, regardless of whether a downhole motor is used, as the bent housing rotates along with the drill string and thus no longer orients the bit in a particular direction. Hence, a bent housing and downhole motor are effective for deviating a borehole.

When a well is substantially deviated by several degrees from vertical and has a substantial inclination, such as by more than 30 degrees, the factors influencing drilling and steering change. This change in factors reduces operational efficiency for a number of reasons.

First, operational parameters such as weight on bit (WOB) and RPM have a large influence on the bit's rate of penetration, as well as its ability to achieve and maintain the required well bore trajectory. As the well's inclination increases and approaches horizontal, it becomes much more difficult to apply weight on bit effectively, as the well bottom is no longer aligned with the force of gravity. Furthermore, the increasing bend in the drill string means that downward force applied to the string at the surface is less likely to be translated into WOB, and is more likely to cause the buckling or deforming of the drill string. Thus, attempting to steer with a downhole motor and a bent sub normally reduces the achievable rate of penetration (ROP) of the operation and makes tool control difficult.

Second, using the motor to change the azimuth or inclination of the well bore without rotating the drill string, a process commonly referred to as "sliding," means that the drilling fluid in most of the length of the annulus is not subject to the rotational shear that it would experience if the drill string were rotating. Drilling fluids tend to be thixotropic, so the loss of this shear adversely affects the ability of the fluid to carry cuttings out of the hole. Thus, in deviated holes that are being drilled with the downhole motor alone, cuttings tend to settle on the bottom or low side of the hole. This increases borehole drag, making weight on bit transmission to the bit very difficult and causing problems with tool phase control and prediction. This difficulty makes the sliding operation very inefficient and time consuming.

Third, drilling with the downhole motor alone during sliding deprives the driller of the advantage of a significant source of rotational energy, namely the surface equipment that would otherwise rotate the drill string and reduce borehole drag and torque. The drill string, which is connected to the surface rotation equipment, is not rotated during drilling with a downhole motor. Additionally, drilling with the motor alone means that a large fraction of the fluid energy is consumed in the form of a pressure drop across the motor in order to provide the rotational energy that would otherwise be provided by equipment at the surface. Thus, when surface equipment is used to rotate the drill string and the bit, significantly more power is available downhole and drilling is faster. This power can be used to rotate the bit or to provide more hydraulic energy at the bit face, for better cleaning and faster drilling.

An alternate way to drill certain wellbores along a predetermined trajectory other than vertical for the purpose of penetrating selected earth formations at a subsurface position different from the surface position of the wellbore uses a drill bit designed according to a imbalance force method, such as the bits in U.S. Pat. Nos. 5,042,596 and 5,010,789. This design attempts to concentrate high imbalance loads toward a certain area of the drill bit. High imbalance loads are created using a cutting zone and bearing zone. The cutting zone includes a plurality of blades and cutting elements. The bearing zone is designed to slip along the borehole wall. A wear resistant surface is provided in the bearing zone area without cutting blades or cutters. The imbalance load compensated drill bits rely on static force calculations, and the static imbalance force often depends on the particular formation to be drilled.

Accordingly, there exists a need for drill bits which can maintain a constant uniform cutting path by applying a constant offset radial force.

SUMMARY OF INVENTION

In one aspect, the present invention relates to a drill bit that includes a drill bit body having a cutting structure face, a pin having a first central axis for attaching the drill bit body to a drill string, where the cutting structure face has a second central axis misaligned from the first central axis.

In another aspect, the present invention relates to a drill bit that includes a drill bit body having a cutting structure face and a pin having a first central axis for attaching the drill bit body to a drill string, where the cutting structure face has a second central axis aligned at an angle relative to the first central axis.

Other aspects and advantages of the invention will be apparent from the following description and the appended claims.

DETAILED DESCRIPTION

In one aspect, embodiments of the invention relate to a drill bit which may be used in directional drilling. More specifically, embodiments of the present invention relate to a drill bit having a cutting structure which is offset from the central axis of the connection to the drill string.

Figure 1:
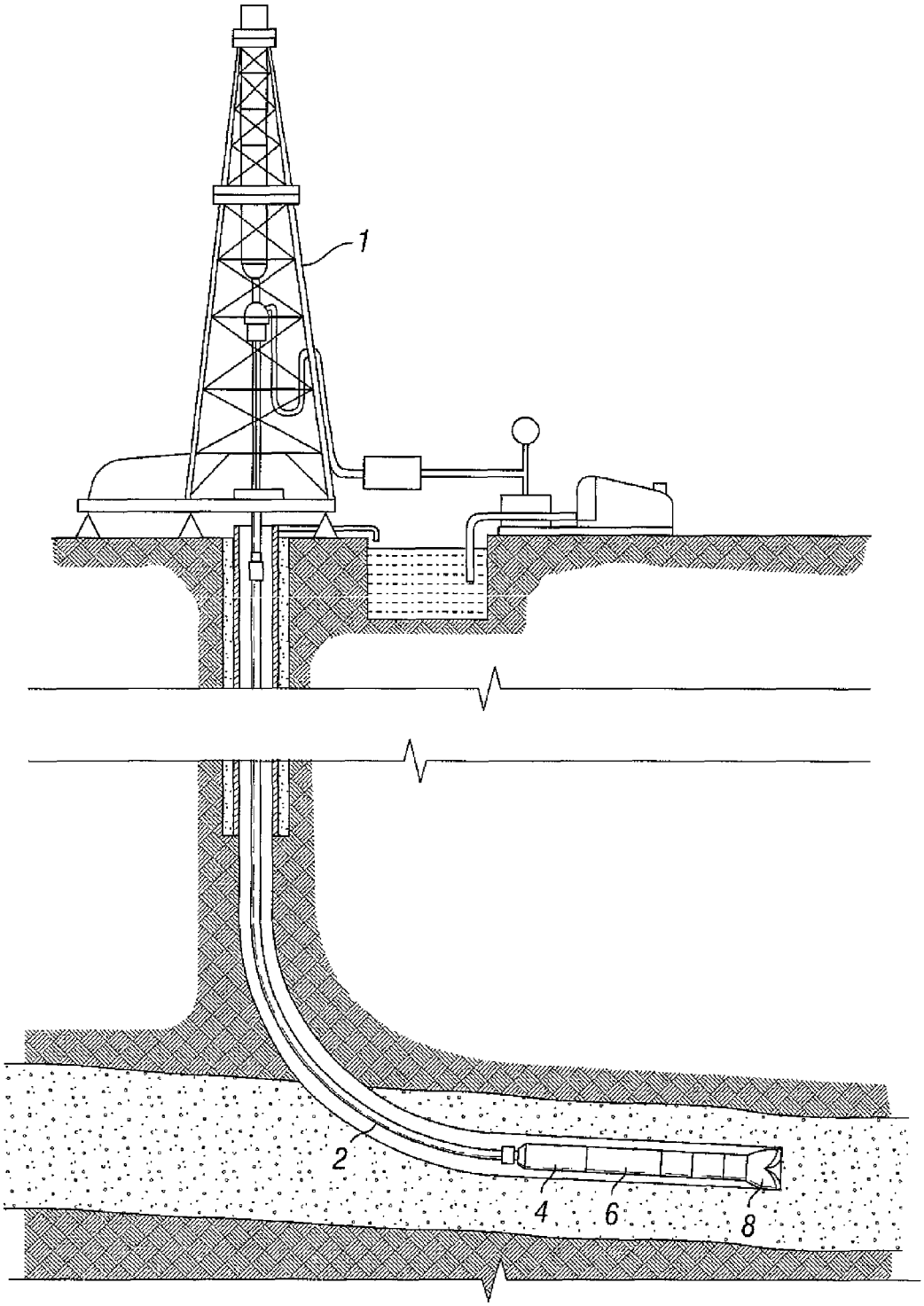
FIG. 1 (Prior Art)
FIG. 1 is an illustration of a drilling system.
Figure 2:
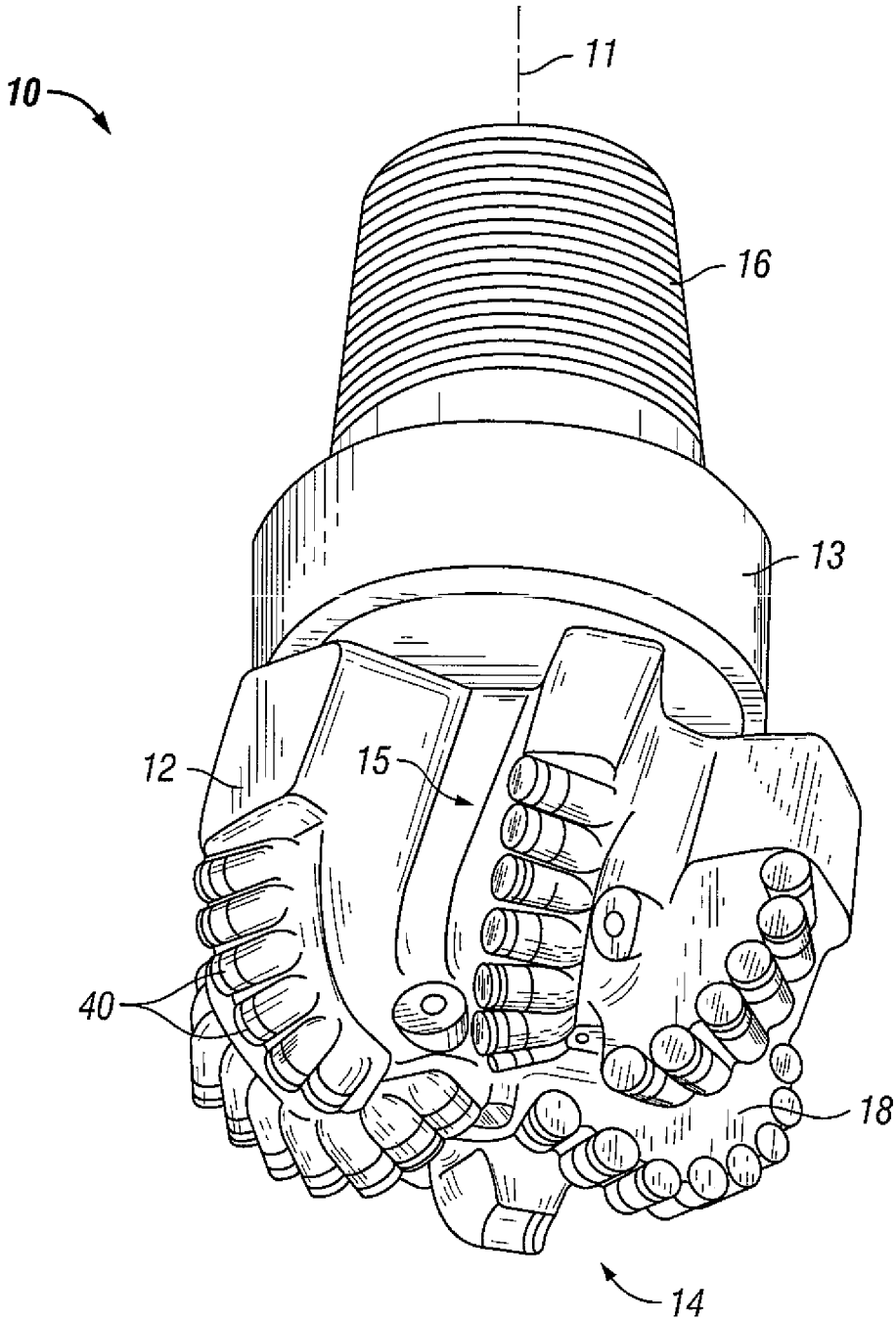
FIG. 2 (Prior Art)
FIG. 2 is a perspective view of a fixed cutter drill bit.

A typical PDC bit 10 is shown in FIG. 2. Bit 10 is a fixed cutter bit, sometimes referred to as a drag bit, adapted to be attached to a drill string and rotated for drilling through formations of rock to form a borehole. Bit 10 generally includes a bit body 15 having a shank 13, and pin 16 for connecting the bit 10 to a drill string (not shown separately) that is employed to rotate the bit for drilling the borehole. A typical bit 10 is formed in a generally cyclindrical shape uniformly positioned about a central axis 11 and a cutting structure on the face 14 of the drill bit, including a plurality of blades 18 extending radially from the center of the cutting face 14 and various PDC cutting elements 40 at radial positions along the blades 18 out toward gage pads 12. Gage pads 12 sit on the other surface of the blades 18 and bit 10, forming the diameter of the bit and establishing the bit's size.

Figure 3:
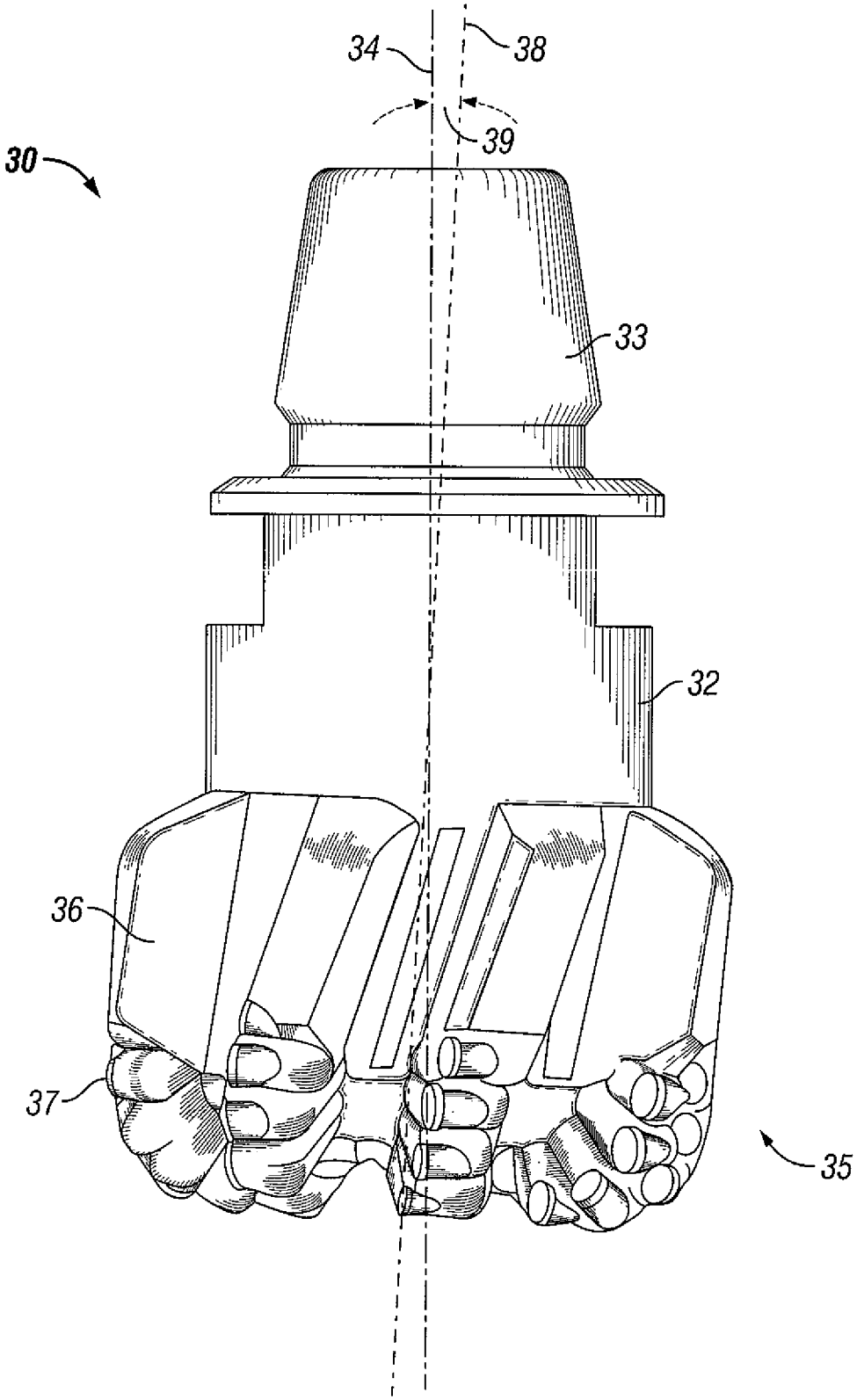
FIG. 3 is a side elevation view of a drill bit according to one embodiment of the present invention.

A drill bit according to some embodiments of the present invention is shown in FIG. 3. Referring to FIG. 3, a drill bit 30 includes a bit body having a shank 32, and a pin 33 for connecting the drill bit 30 to a drill string (not shown separately) that is employed to rotate the drill bit 30 for drilling a borehole. The pin 33 is a threaded pin that has a first central axis 34 about which the pin 33 is rotated by the drill string (not shown separately). The bit body includes a cutting structure face 35 formed by the plurality of blades 36 radially extending from the bit body and the plurality of cutting elements 37 disposed in pockets (not shown separately) along the peripheral edges of the blades 36. The cutting elements 37 define a cutting profile for each blade 36 and the plurality of cutting elements 37 and blades 36 define the cutting structure face 35 of the drill bit. The cutting structure face 35 has a second central axis 38 about which it rotates. The second central axis 38 is misaligned with the first central axis 34 by an angle 39.

According to one embodiment, the angle 39 is in a range from about 0.15 degrees to about 7 degrees. In one embodiment of the present invention, the angle 39 is created by machining the pin connection at a slightly misaligned angle to the cutting structure's central axis.

In another embodiment, the angle 39 is created when the matrix bit body is formed. A matrix bit body is a casting which is made in a mold. Molten binder material is infiltrated into the mold cavity which contains tungsten carbide powder. Typically the mold also contains an internal steel structural blank which provides support and structural strength for the matrix body. Binder metal which is contained in a funnel on top of the mold is melted. Molten binder flows downward, infiltrating the tungsten carbide powder by capillary action. After cooling, the binder solidifies. The misaligned second central axis 38 may be created by pouring the matrix binder into a mold which has a central axis that would be either at an angle or offset once the bit body is connected to the pin.

In the embodiment with an angled second central axis, the angle may be a slight angle of between about 0.15 degrees and 7 degrees. In the embodiment with the second axis being offset parallel to the first central axis of the pin, the offset may be in a range of about 0.01 inches to about 0.5 inches.

Figure 4:
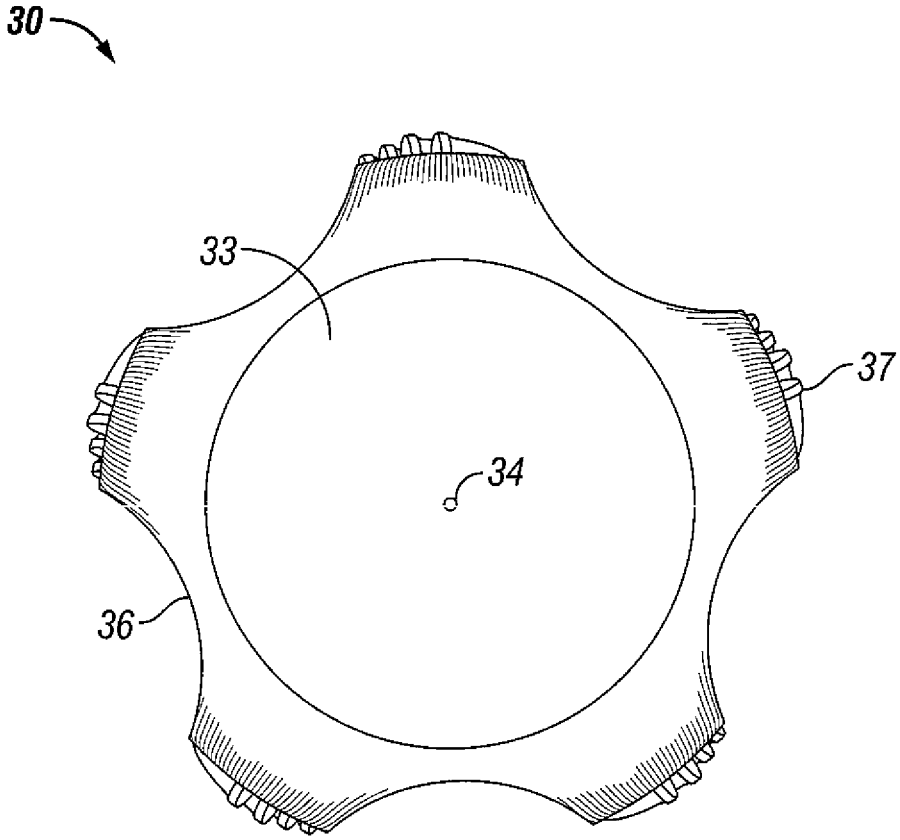
FIG. 4 is a top view of the drill bit of FIG. 3.

Referring to FIG. 4, the drill bit 30 of FIG. 3 is shown from a top view, looking down the first central axis 34 of the pin 33.

Figure 5:
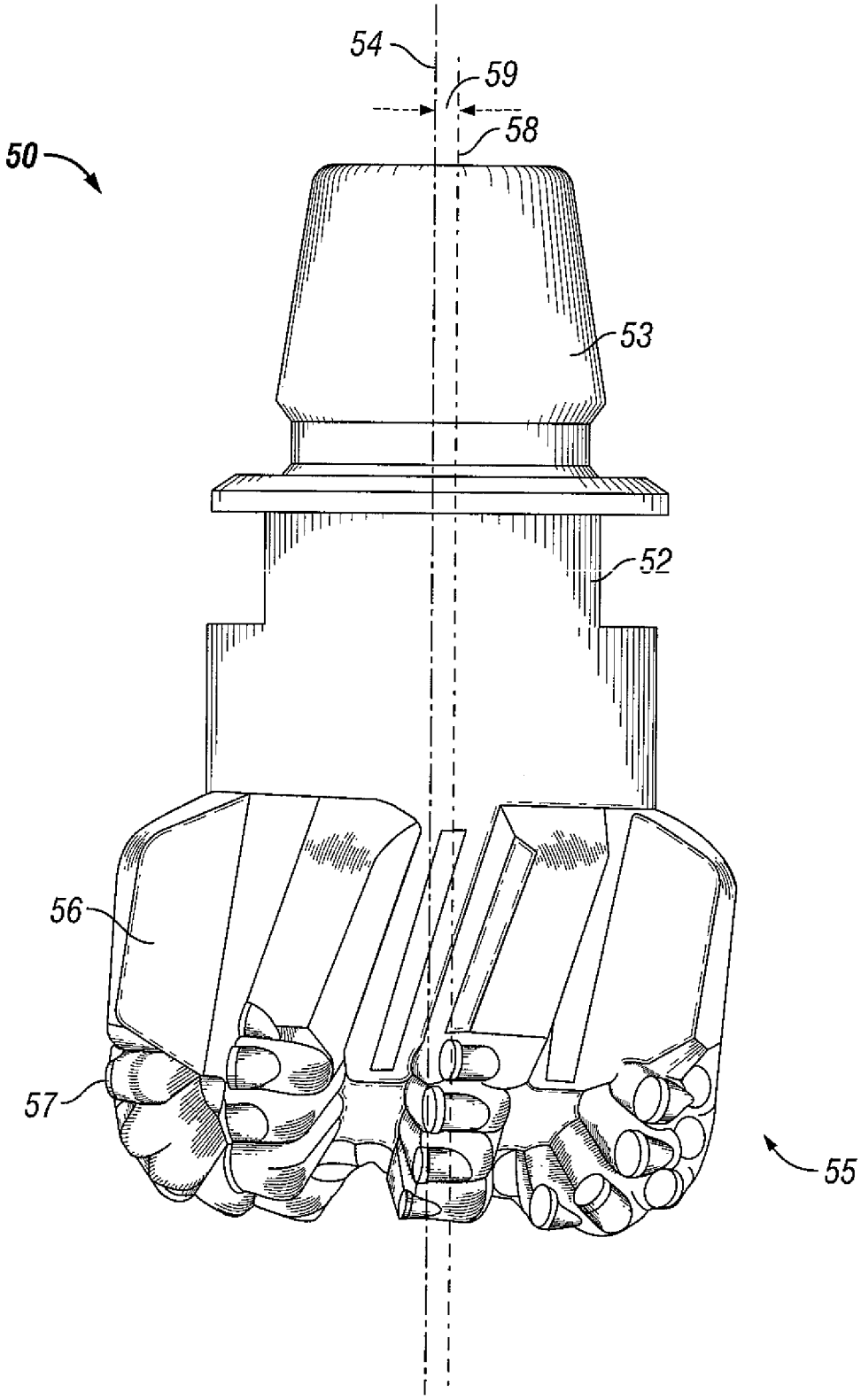
FIG. 5 is side elevation view of a drill bit according to another embodiment of the present invention.

A drill bit according to other embodiments of the present invention is shown in FIG. 5. Referring to FIG. 5, a drill bit 50 includes a bit body having a shank 52, and a pin 53 for connecting the drill bit 50 to a drill string (not shown separately) that is employed to rotate the drill bit 50 for drilling a borehole. The pin 53 has a first central axis 54 about which the pin 53 is rotated by the drill string (not shown separately). The bit body includes a cutting structure face 55 formed by the plurality of blades 56 radially extending from the bit body and the plurality of cutting elements 57 disposed in pockets (not shown separately) in the blades 56. The cutting structure face 55 has a second central axis 58 about which it rotates. The second central axis 58 is laterally misaligned with the first central axis 54 by a distance 59.

In one embodiment of the present invention, the distance 59, by which the second central axis is offset from the first central axis is in a range from about 0.01 inches to about 0.5 inches. In another embodiment of the present invention, the distance 59 is in a range from about 0.1 inches to about 0.25 inches. The lateral misalignment of the second central axis 58 from the first central axis 54 by a distance 59 may be created, in one embodiment by machining the pin connection. In another embodiment, the matrix bit body can be formed from a mold which would create the offset central axis.

Figure 6:
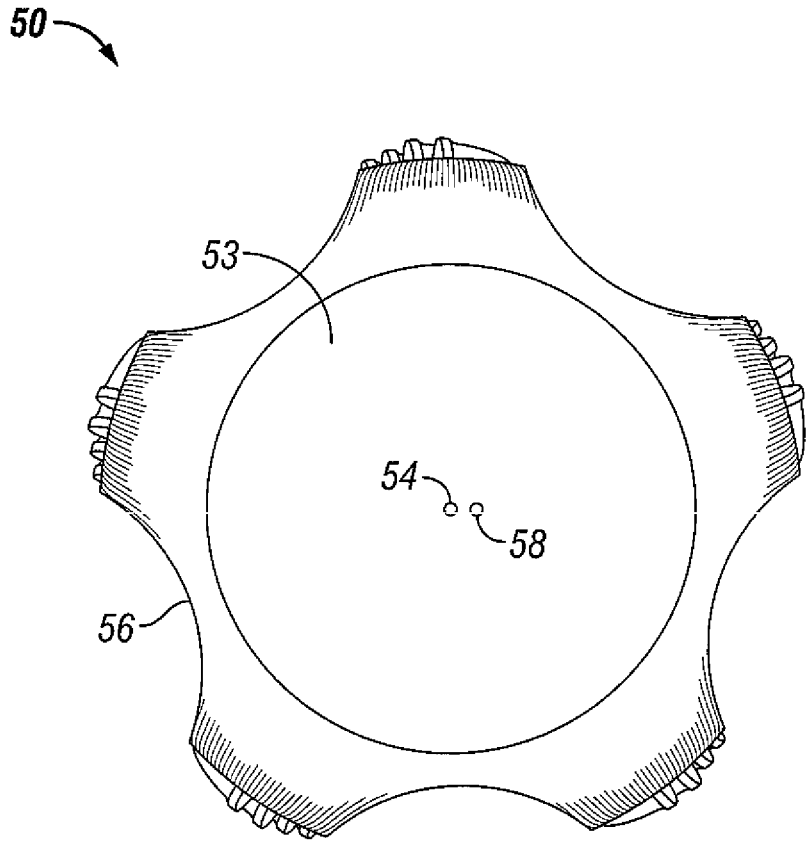
FIG. 6 is a top view of the drill bit of FIG. 5

Referring to FIG. 6, a top perspective of the drill bit 50 of FIG. 5 is shown, looking down the first central axis 54 of the pin 53.

According to some embodiments of the present invention, the plurality of blades are positioned at an even density about the bit body. In other embodiments, the plurality of blades are positioned at a biased density about the bit body, having a higher density on one portion of the bit body and a lower density on another portion. At least one portion of he bit body includes a gage area, establishing the size of the bit. The gage are may be on an exterior or radial side of one or more of the blades. Alternatively, the gage area may be formed on the bit body between the blades and the pin. At least one gage area may be covered with the wear coating to protect the blade from wear against the formation, especially in the area of maximum contact with the formation. In some embodiments, this area is the portion of the bit body having the maximum offset from the axis about which the drill string rotates the drill bit.

According to some embodiments of the present invention, the cutting structure face may have a central axis misaligned from the axis about which the drill string rotates. In one embodiment, the cutting structure face's misalignment is by an angle relative to the drill string's axis of rotation. In other embodiments, the cutting structure face's misalignment is a lateral and parallel offset from the drill string's axis of rotation. The cutting structure face having such a central axis misaligned, either laterally or by an angle, from the axis about which the drill string rotates the drill bit may create a radial force applied to the cutting structure. This radial force when drilling in a non-vertical borehole may cause the bit to "walk" in one direction or another direction depending upon the rotation direction and the angle of the borehole. This "walking" may be used to create a drilling trajectory.

The embodiments of the invention may include one or more of the useful features. For example, a drill bit including a cutting structure face having a central axis which is misaligned from the axis about which a drill string rotates the drill bit may create a constant offset radial force applied to the cutting structure. A drill bit having a constant radial force may allow cutting elements to maintain uniform cutting paths even when extremely unbalanced cutting loads are experienced. Such a constant radial force may provide additional stability to the drill bit when drilling though transitions between hard and soft and between soft and hard layers of the formation as well as through layers having composite hardness. An offset cutting structure of the drill bit may also allow the bit to maintain contact with the borehole in a specific location. Additionally, embodiments of the invention may provide a bearing location at the specified point of borehole contact.

Furthermore, by orienting the cutting structure at a predetermined angle or lateral displacement, a large radial force may be supplied by the drill string. This radial force may allow for controlled directional drilling. Furthermore, the misaligned second central axis may allow for a constant radial force that is not dependent upon the formation desired to be drilled.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A fixed cutter drill bit, comprising:

a drill bit body having a cutting structure face; and a pin, having a first central axis, for attaching the drill bit body to a drill string, wherein the cutting structure face has a second central axis misaligned with the first central axis.

2. The drill bit of claim 1, wherein the cutting structure face comprises a plurality of blades extending radially from the drill bit body.

3. The drill bit of claim 2, wherein a plurality of cutting elements are disposed on the plurality of blades.

4. The drill bit of claim 1, wherein the second central axis is misaligned at an angle in a range of about 0.15 degrees to about 7 degrees.

5. The drill bit of claim 1, wherein the second central axis is offset in a range of between 0.01 inches to about 0.5 inches.

6. The drill bit of claim 1, wherein the misaligned second central axis is created by machining the pin at an angle relative to the first central axis.

7. The drill bit of claim 1, wherein the misaligned second central axis was created by machining the pin parallel to and offset from the first central axis.

8. The drill bit of claim 1, wherein the offset second central axis is created by forming a bit body matrix having a central axis misaligned from the first central axis of the pin.

9. The drill bit of claim 8, wherein second central axis is misaligned at an angle relative to the first central axis.

10. The drill bit of claim 8, wherein the second central axis is parallel to and offset from the first central axis.

11. The drill bit of claim 2, wherein at least one of the plurality of blades comprises a gage area.

12. The drill bit of claim 11, wherein at least a portion of the gage area is covered with a wear coating.

13. A fixed cutter drill bit, comprising:

a drill bit body having a cutting structure face; and a pin, having a first central axis, for attaching the drill bit body to a drill string, wherein the cutting structure face has a second central axis aligned at an angle relative to the first central axis.

14. The drill bit of claim 13, wherein the angle between the first central axis and the second central axis ranges from about 0.15 degrees to about 7 degrees.

15. The drill bit of claim 13, wherein the cutting structure face comprises a plurality of blades extending radially from the cutting structure face.

16. The drill bit of claim 15, wherein a plurality of cutting elements are disposed on the plurality of blades.

17. The drill bit of claim 15, wherein at least one of the plurality of blades comprises a gage area.

18. The drill bit of claim 17, wherein at least a portion of the gage area is covered with a wear coating.

19. The drill bit of claim 13, wherein the second central axis aligned at an angle relative to the first central axis was created by machining the pin.

20. The drill bit of claim 13, wherein the second central axis aligned at an angle relative to the first central axis is created by forming a bit body matrix having a central axis aligned at an angle relative to the first central axis of the pin.

* * * * *